US008305005B2

(12) United States Patent
Fu et al.

(10) Patent No.: US 8,305,005 B2
(45) Date of Patent: Nov. 6, 2012

(54) INTEGRATED CIRCUIT FOR DRIVING HIGH-VOLTAGE LED LAMP

(75) Inventors: Wei-Chen Fu, Xinfeng Township, Hsinchu Country (TW); Wei-Chen Liang, Baoshan Township, Hsinchu County (TW); Wen-Cen Li, Hsinchu (TW); Bo-Wen Hou, Hsinchu (TW); Ching-Sung Lo, Daya Township, Taichung County (TW)

(73) Assignee: Integrated Crystal Technology Inc., Hsinchu (TW)

( * ) Notice: Subject to any disclaimer, the term of this patent is extended or adjusted under 35 U.S.C. 154(b) by 184 days.

(21) Appl. No.: 12/877,157

(22) Filed: Sep. 8, 2010

(65) Prior Publication Data

US 2012/0056559 A1 Mar. 8, 2012

(51) Int. Cl.
*H05B 41/16* (2006.01)

(52) U.S. Cl. ..... 315/247; 315/291; 315/224; 315/307; 315/312

(58) Field of Classification Search ..... 315/247, 315/291, 224, 225, 307–326
See application file for complete search history.

(56) References Cited

U.S. PATENT DOCUMENTS

| | | | | |
|---|---|---|---|---|
| 6,441,558 | B1 | 8/2002 | Muthu et al. | |
| 6,798,152 | B2 | 9/2004 | Rooke et al. | |
| 7,135,825 | B2 | 11/2006 | Tanabe | |
| 7,288,900 | B2 | 10/2007 | Biebl et al. | |
| 7,489,086 | B2 | 2/2009 | Miskin et al. | |
| 7,528,551 | B2 | 5/2009 | Ball | |
| 7,592,755 | B2 | 9/2009 | Chen et al. | |
| 7,642,725 | B2 | 1/2010 | Cusinato et al. | |
| 2002/0140379 | A1 | 10/2002 | Chevalier et al. | |
| 2006/0082332 | A1 * | 4/2006 | Ito et al. | 315/291 |

* cited by examiner

*Primary Examiner* — Tuyet Thi Vo
(74) *Attorney, Agent, or Firm* — Chun-Ming Shih; HDLS IPR Services

(57) ABSTRACT

An integrated circuit for driving high-voltage LED lamps is applied to a rectified alternative current (AC) power and a plurality of LED stacks. The integrated circuit includes a control unit, a plurality of current-clamping units which electrically connect to the control unit and the LED stacks respectively, and a plurality of current-sensing units which electrically connect to the current-clamping units and the control unit. When the rectified power is switched on, the current-sensing unit constantly monitors the electrical current flowing through the respective current-clamping unit and feeds back the monitored data to the control unit. The control unit sequentially switches on or off the current-clamping units according to the combinatorial logic state of the monitored data.

9 Claims, 7 Drawing Sheets

| logic state | I1 | I2 | I3 | I4 | I5 | I6 | S2 | S3 | S4 | S5 | S6 | G1 | G2 | G3 | G4 | G5 | G6 |
|---|---|---|---|---|---|---|---|---|---|---|---|---|---|---|---|---|---|
| 1 | 0 | 0 | 0 | 0 | 0 | 1 | 0 | 0 | 0 | 0 | 1 | 0 | 0 | 0 | 0 | 0 | 1 |
| 2 | 0 | 0 | 0 | 0 | 1 | 0 | 0 | 0 | 0 | 1 | 0 | 0 | 0 | 0 | 0 | 1 | 1 |
| 3 | 0 | 0 | 0 | 1 | 0 | 0 | 0 | 0 | 1 | 0 | 0 | 0 | 0 | 0 | 1 | 1 | 1 |
| 4 | 0 | 0 | 1 | 0 | 0 | 0 | 0 | 1 | 0 | 0 | 0 | 0 | 0 | 1 | 1 | 1 | 1 |
| 5 | 0 | 1 | 0 | 0 | 0 | 0 | 1 | 0 | 0 | 0 | 0 | 0 | 1 | 1 | 1 | 1 | 1 |
| 6 | 1 | 0 | 0 | 0 | 0 | 0 | 0 | 0 | 0 | 0 | 0 | 1 | 1 | 1 | 1 | 1 | 1 |
| 7 | 0 | 0 | 0 | 0 | 0 | 0 | 0 | 0 | 0 | 0 | 0 | 1 | 1 | 1 | 1 | 1 | 1 |

FIG.9

INTEGRATED CIRCUIT FOR DRIVING HIGH-VOLTAGE LED LAMP

BACKGROUND OF THE INVENTION

1. Field of the Invention

The present invention relates to an integrated circuit, and more particularly to an integrated circuit for driving high-voltage LED lamp.

2. Description of Prior Art

At present, the LEDs (light-emitting diodes) are widely used, such as LED lamps. However, the prior arts of LED lamp drivers generally have a drawback that the driving circuit can not be integrated into one single semiconductor chip.

The following patents: US 2006/0038542 A1, US 2008/0129220 A1, US 2003/0122502 A1, U.S. Pat. Nos. 6,798,152 B2, 7,135,825 B2, 7,489,086 B2, 7,528,551 B2 , 7,592,755 B2, 6,441,558 B1, 7,288,900 B2, US 2002/0140379 A1, and U.S. Pat. No. 7,642,725 B2 disclosed the lighting applications of the LEDs. All of the above-mentioned lighting applications use at least one of the following devices: transformer, DC power supply, large inductor, large capacitor, and light sensor. Thus, it is impossible to integrate all the bulky devices into one semiconductor chip by using the existing semiconductor processes.

WO 2007/001116 A1 disclosed high-voltage switches with different potentials. In the existing semiconductor manufacturing processes for high voltage resistance, however, there are not suitable components for using. Accordingly, if the integration can not be realized, the production costs can not be effectively reduced. In addition, the current is instantaneously opened or shorted due to the open-circuit voltage switching, this will result in higher EMI. Furthermore, the conduction current is fixed and the total harmonic distortion (THD) is larger than 42%. The existing lighting regulation that the THD has to be smaller than 33% can not be satisfied.

U.S. Pat. No. 6,989,807 disclosed the detection of the voltage level of the input power to turn on and turn off the current-driving circuits in order. However, the temperature variation is neglected due to the forward voltage. This will easily result in higher voltage across the current-driving circuits to reduce the use efficiency. In addition, the optimal switching time can not be controlled and it causes the EMI and the harmonic distortion. Furthermore, the driving current is fixed and the THD is larger than 42%. The existing lighting regulation demanding THD to be smaller than 33% can not be satisfied, even though the power factor is larger than 90%.

SUMMARY OF THE INVENTION

In order to overcome the above-mentioned disadvantages, an integrated circuit for driving high-voltage LED lamp is disclosed that the integrated circuit can be integrated and conform the demands of the existing lighting regulation.

In order to achieve the above-mentioned objects, the integrated circuit for driving high-voltage LED lamps is applied to a rectified power and a plurality of LED stacks. The integrated circuit for driving high-voltage LED lamps includes a control unit, a plurality of current-clamping units electrically connected to the control unit and the respective LED stacks, and a plurality of current-sensing unit electrically connected to the respective current-clamps units and the control unit. The first stage of the current-clamping could permit without electrically connecting a current-sensing unit. When the rectified power is switched on, the current-sensing unit constantly monitors the electrical current flowing through the respective current-clamping unit and feeds back the monitored data to the control unit. The control unit sequentially switches on or off the current-clamping units according to the combinatorial logic state of the monitored data.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

FIG. 9 is a truth table of the logic gates inside the control unit.

DETAILED DESCRIPTION OF THE INVENTION

Figure 1:
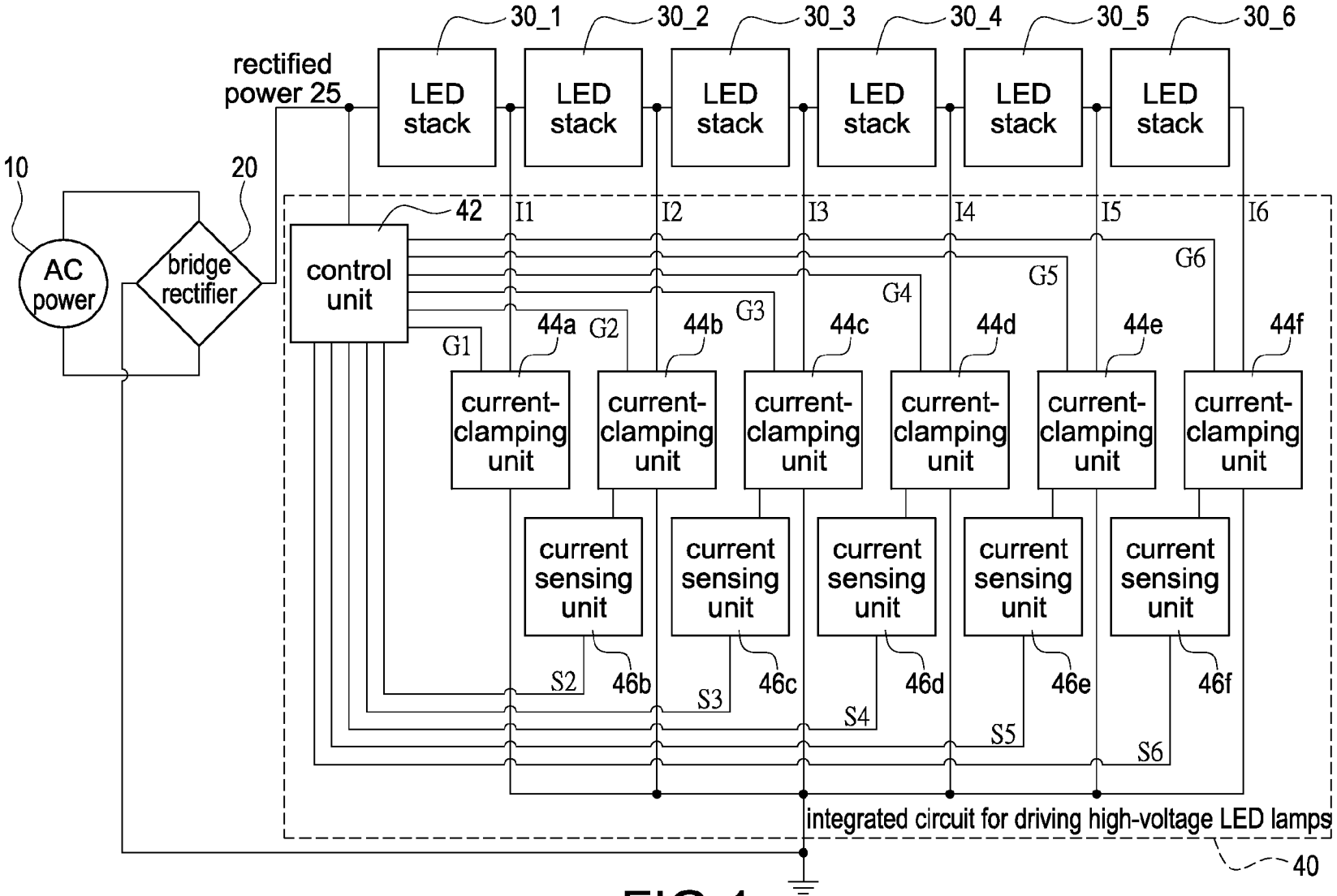
FIG. 1 is a block diagram of an embodiment of an integrated circuit for driving high-voltage LED lamp according to the present invention.

Reference will now be made to the drawing to describe the present invention in detail.

Reference is made to FIG. 1 which is a block diagram of an embodiment of an integrated circuit for driving high-voltage LED lamp according to the present invention. The integrated circuit for driving high-voltage LED lamps 40 is applied to an AC power 10, a bridge rectifier 20, and a plurality of LED stacks 30_1-30_6. In this embodiment, the amount of the LED stacks 30_1-30_6 is six, but this example is for demonstration and not for limitation. The integrated circuit for driving high-voltage LED lamps 40 includes a control unit 42, a plurality of current-clamping units 44*a*-44*f*, and at least one current-sensing unit 46*b*-46*f*. In particular, the amount of the current-clamping units 44*a*-44*f* and the amount of the current-sensing units 46*b*-46*f* are five, but this example is for demonstration and not for limitation.

In order to conveniently describe the integrated circuit for driving high-voltage LED lamps, an electrical wire between the control unit 42 and the current-clamping unit 44*a* is referred to as G1, and an electrical wire between the control unit 42 and the current-clamping unit 44*b* is referred to as G2. The rest of the electrical wires G3-G6 can be deduced by the same analogy. An electrical wire between the control unit 42 and the current-sensing unit 46*b* is referred to as S2. The rest of the electrical wires S3-S6 can be deduced by the same analogy. In addition, a conduction current flowing through the current-clamping unit 44*a* is referred to as I1, and a conduction current flowing through the current-clamping unit 44*b* is referred to as I2. The rest of the conduction currents I3-I6 can be deduced by the same analogy.

The control unit 42 is electrically connected to the bridge rectifier 20, the LED stack 30_1, the current-clamping units 44*a*-44*f*, and the current-sensing units 46*b*-46*f*. The current-clamping unit 44*a* is electrically connected to the LED stacks 30_1, 30_2. The current clamping-unit 44*b* is electrically connected to the LED stacks 30_2, 30_3 and the current-sensing unit 46*b*. The current-clamping unit 44*c* is electrically connected to the LED stacks 30_3, 30_4 and the current-sensing unit 46*c*. The current-clamping unit 44*d* is electrically connected to the LED stacks 30_4, 30_5 and the current-sensing unit 46*d*. The current-clamping unit 44*e* is electrically connected to the LED stacks 30_5, 30_6 and the current-sensing unit 46*e*. The current-clamping unit 44*f* is electrically connected to the LED stack 30_6 and the current-sensing unit 46*f*. The bridge rectifier 20 is electrically connected to the AC power 10, the control unit 42, and the LED stack 30_1.

The bridge rectifier 20 is used to provide a full-wave rectification to the AC power 10. It is assumed that the AC power 10 is 220 volts, thus full-wave rectified peak value of the AC power 10 is 311 volts. The AC power 10 is rectified to a full-wave rectified power 25 by the bridge rectifier 20. Because the rectified power 25 is not filtered and regulated, the voltage variation of the rectified power 25 is significant (approximately the magnitude of the positive-half sinusoidal wave). The rectified power 25 is supplied to provide the required power to the integrated circuit for driving high-voltage LED lamps 40 and the LED stacks 30_1~30_6.

Figure 2:
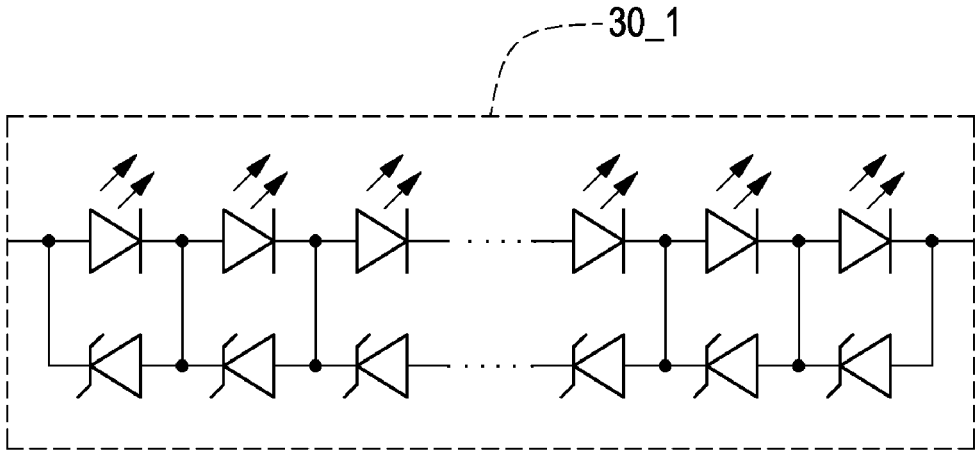
FIG. 2 is a circuit diagram of an LED stack.

Reference is made to FIG. 2 which is a circuit diagram of an embodiment of the LED stacks. The LED stack 30_1 includes a plurality of light-emitting diodes connected in series. Each of the light-emitting diodes is electrically connected to a Zener diode to provide an open-circuit protection. Because the rest of the LED stacks 30_2-30_6 are the same as the LED stack 30_1, the detailed description is omitted here for conciseness.

Figure 3:
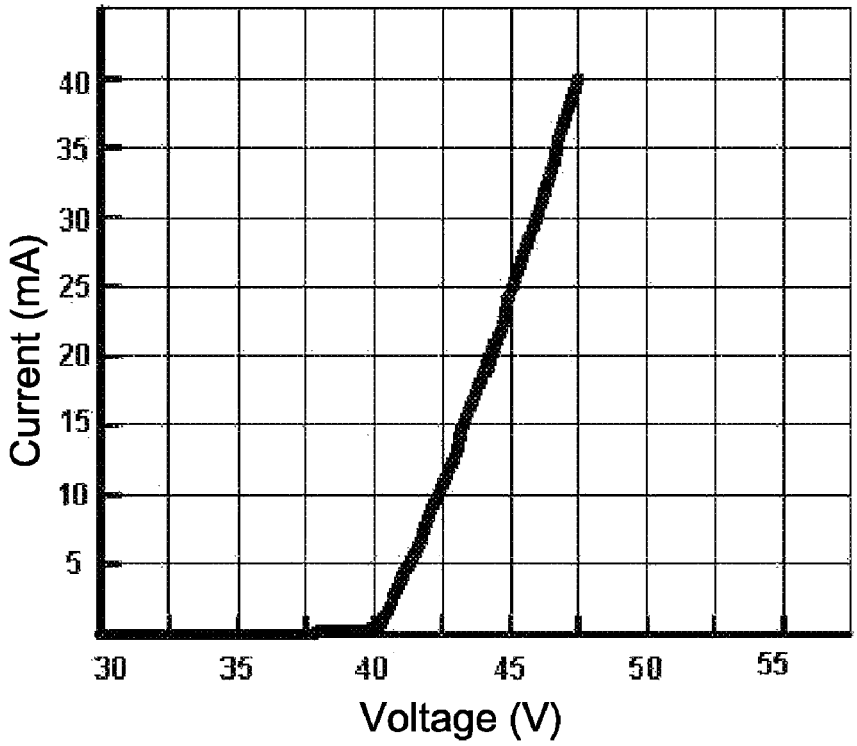
FIG. 3 is a voltage-current curve of an LED stack.

Typically, a light-emitting diode is driven by a 20 mA forward current, thus a 3.6-volt forward voltage is produced across the light-emitting diode. Hence, twelve LEDs are connected in series to form the LED stack 30_1, thus a 43.2-volt forward voltage is produced across the LED stack 30_1 under the 20-mA forward current. Reference is made to FIG. 3 which is a voltage-current curve of the embodiment of the LED stacks. In this example, the LED stack 30_1 with twelve light-emitting diodes is exemplified for further demonstration. The abscissa represents the forward voltage across the LED stack 30_1, and the ordinate represents the forward current through the LED stack 30_1.

An LED array for high voltage resistance can be formed by connecting the LED stacks 30_1-30_6 in series. In a practical application of a 220-volt AC power, six LED stacks connected in series are driven by the 20-mA current to approximately produce a 311-volt forward voltage, which is nearly equal to the peak of the full-wave rectified voltage.

Figure 4:
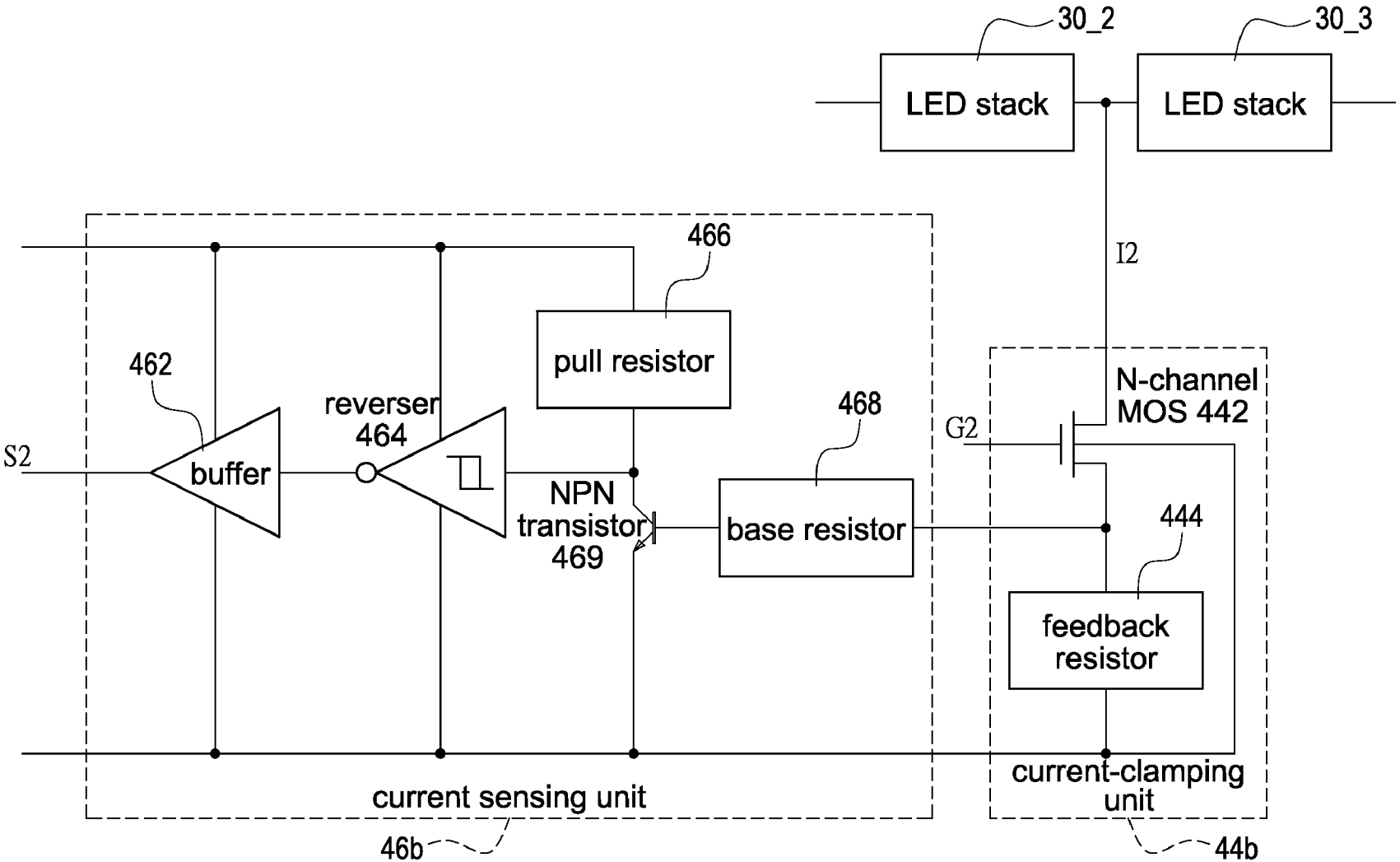
FIG. 4 is a block diagram of an embodiment of a current-clamping unit and a current-sensing unit.

Reference is made to FIG. 4 which is a block diagram of an embodiment of a current-clamping unit and a current-sensing unit. The current-clamping unit 44*b* includes an N-channel MOS 442 and a feedback resistor 444. The feedback resistor 444 is electrically connected to a source of the N-channel MOS 442. A gate of the N-channel MOS 442 is electrically connected to the control unit 42 (not shown) through the electrical wire G2. A drain of the N-channel MOS 442 is electrically connected to the LED stacks 30_2, 30_3.

When the electrical wire G2 is set at a fixed high-voltage level, representing logic 1, by the control unit 42, the N-channel MOS 442 is turned on. The conduction current I2 through the N-channel MOS 442 is controlled by a voltage difference between the gate and the source of the N-channel MOS 442 and the feedback resistor 444. When the conduction current I2 increases, a voltage difference is resulted across the feedback resistor 444, the gate to source voltage of the N-channel MOS 442 is reduced and, thus, the conduction current I2 is clamped to a fixed value.

Because the current-clamping unit 44*a* and the current-clamping units 44*c*-44*f* are similar to the current-clamping unit 44*b*, the detail description of the current-clamping unit 44*a* and the clamping-units 44*c*-44*f* are omitted here for conciseness. In particular, the value of the feedback resistor 444 of the current-clamping unit 44*a* is different from those of the current-clamping units 44*b*-44*f*. The resistance value of the feedback resistor 444 of the current-clamping unit 44*a* is 750 ohms, and those of the current-clamping units 44*b*-44*f* are 550 ohms, 400 ohms, 300 ohms, 200 ohms, and 180 ohms, respectively. The purpose of the different value of the feedback resistors is in order to improve the power factor to nearly 100% and reduce the total harmonic distortion to nearly 0%.

The current-sensing unit 46*b* includes an NPN transistor 469, an inverter 464, a buffer 462, a pull resistor 466, and a base resistor 468. An input terminal of the inverter 464 is electrically connected to a collector of the NPN transistor 469. An input terminal of the buffer 462 is electrically connected to an output terminal of the inverter 464, and the output terminal of the inverter 464 is electrically connected to the control unit 42 through the electrical wire S2. The pull resistor 466 is electrically connected to the collector of the NPN transistor 469. One terminal of the base resistor 468 is electrically connected to a base of the NPN transistor 469, and the other terminal of the base resistor 468 is electrically connected to the feedback resistor 444 and the source of the N-channel MOS 442.

The current-sensing unit 46*b* is provided to detect the voltage across the feedback resistor 444. When the conduction current I2 is greater than a default current, the voltage across the feedback resistor 444 turns on the NPN transistor 469. The pull resistor 466 is provided to amplify voltage signal. The inverter 464 with a hysteresis characteristic is used to be a simple hysteresis comparator when a voltage signal of a collector of the NPN transistor 469 is inputted to the inverter 464. Hence, the current-sensing unit 46*b* outputs a logical high level (logical 1) to the control unit 42 when the sufficient conduction current I2 flows through the feedback resistor 444. On the other hand, the current-sensing unit 46*b* outputs a logical low level (logical 0) to the control unit 42. Because the rest of the current-sensing units 46*c*-46*f* are the same as the current-sensing unit 46*b*, the detailed description is omitted here for conciseness.

Figure 5:
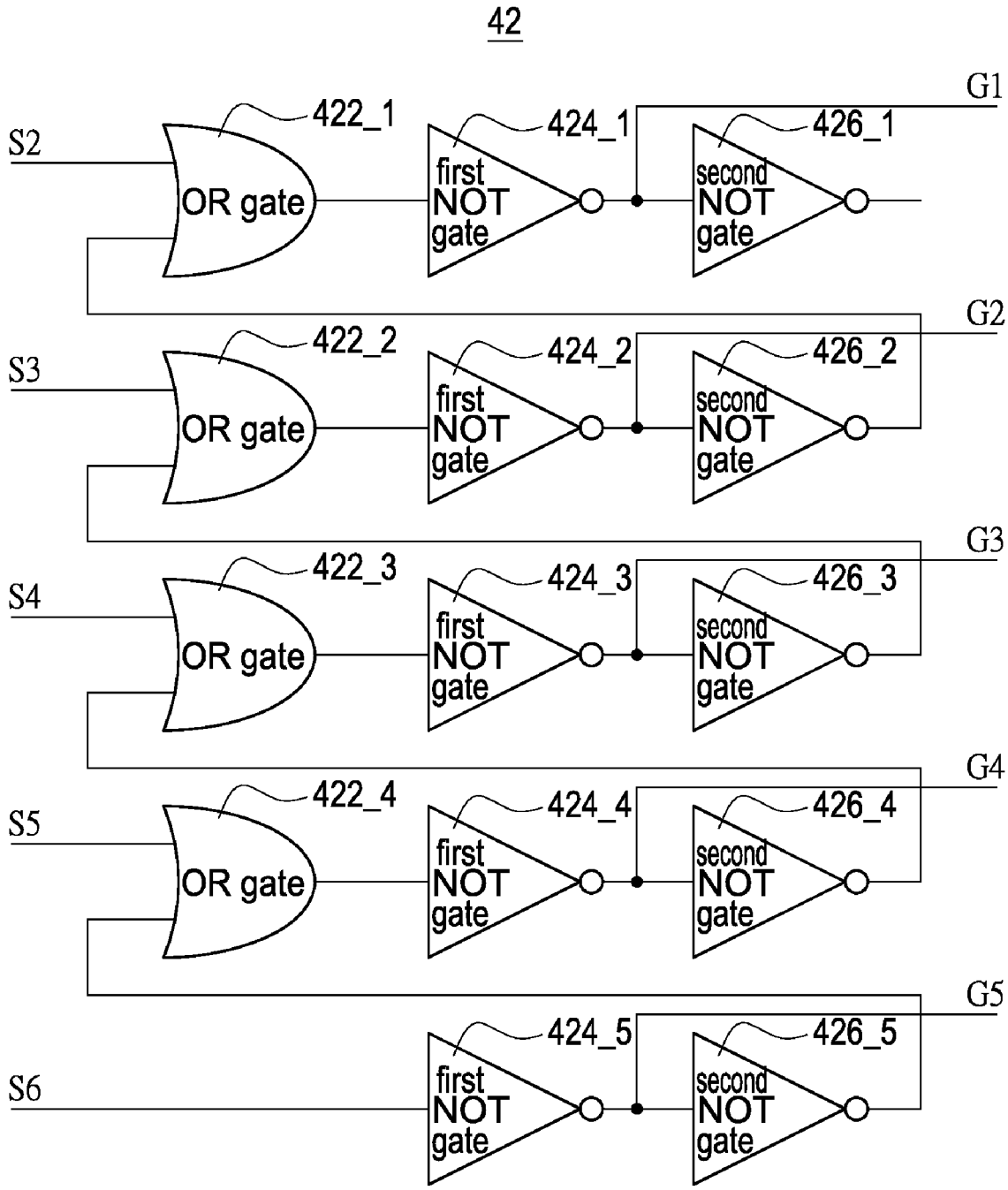
FIG. 5 is a block diagram of an embodiment of a control unit.

Reference is made to FIG. 5 which is a block diagram of an embodiment of a control unit. The control unit 42 includes at least one first NOT gate 424, at least one second NOT gate 426, and at least one OR gate 422. In this embodiment, the amount of the first NOT gates 424_1-424_5, the amount of the second NOT gates 426_1-426_5 are five, and the amount of the OR gates 422_1-422_4 is four. The input terminals of the second NOT gates 426_1-426_5 are electrically connected to the output terminals of the first NOT gates 424_1-424_5 and the electrical wires G1-G5, respectively. The output terminals of the OR gates 422_1-422_4 are electrically connected to the input terminals of the first NOT gates 424_1-424_4. One input terminal of each of the OR gates 422_1-422_4 is electrically connected to the electrical wires S2-S5, respectively; the other terminal of each of the OR gates 422_1-422_4 is electrically connected to the output terminal of the second NOT gates 426_2-426_5, respectively. The input terminal of the first "NOT" terminal 424_5 is electrically connected to the electrical wire S6.

The control unit 42 receives logical signals of the current-sensing units 46*b*-46*f*. The logical signals are operated to output corresponding fixed-voltage logical signals to control the current-clamping unit 44*a* and the current-clamping units 44*b*-44*f*. In particular, the conduction current I1 does not require to be monitored, and the current-clamping unit 44*f* is fixed at a logical high level. A truth table of operating the electrical wires is shown as follows. Because the logical operation is well known in the art, the detailed description of producing the truth table is omitted here for conciseness and only the truth table is shown in FIG. 9.

Figure 6:
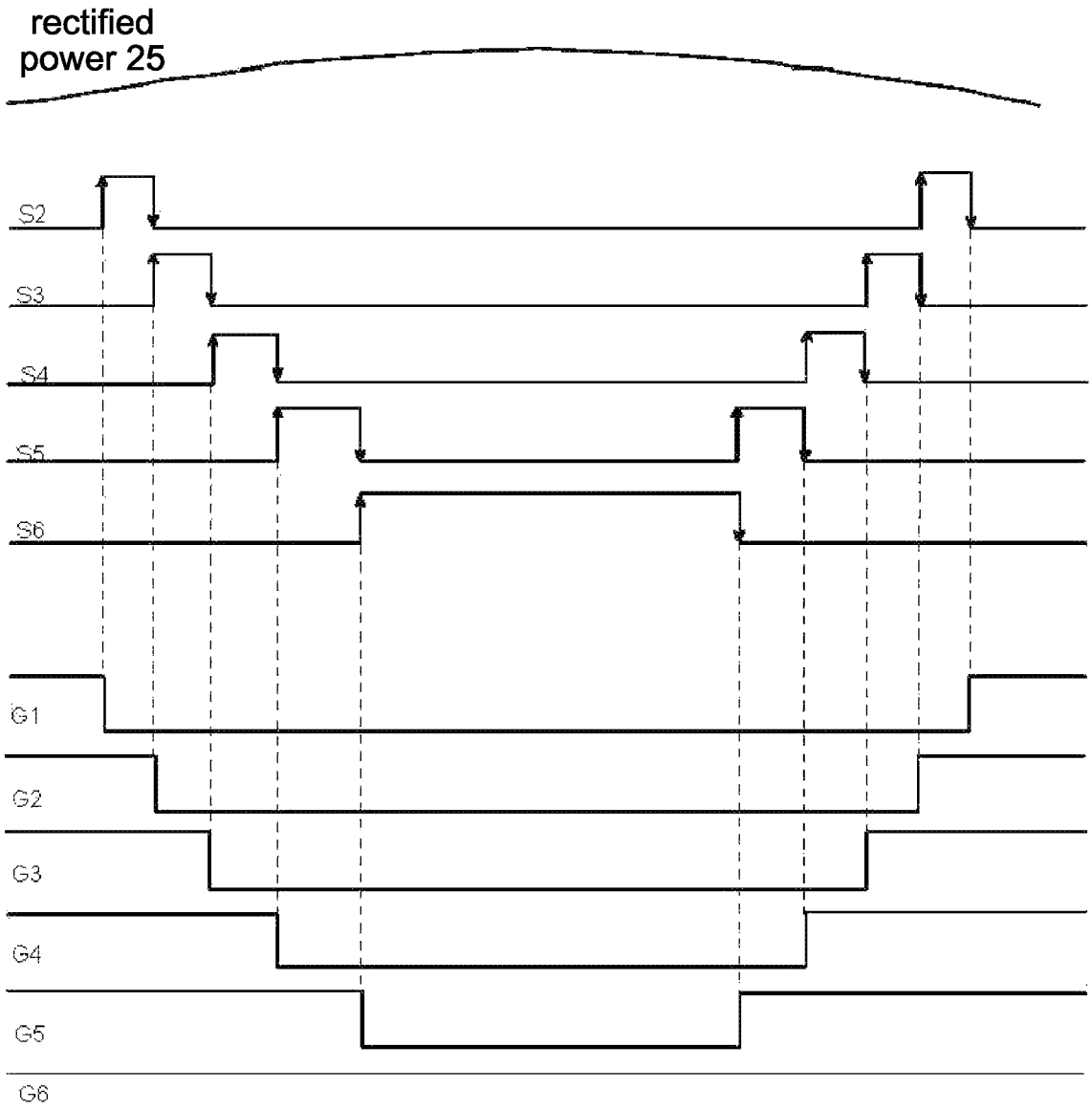
FIG. 6 is a timing diagram of a control unit.
Figure 7:
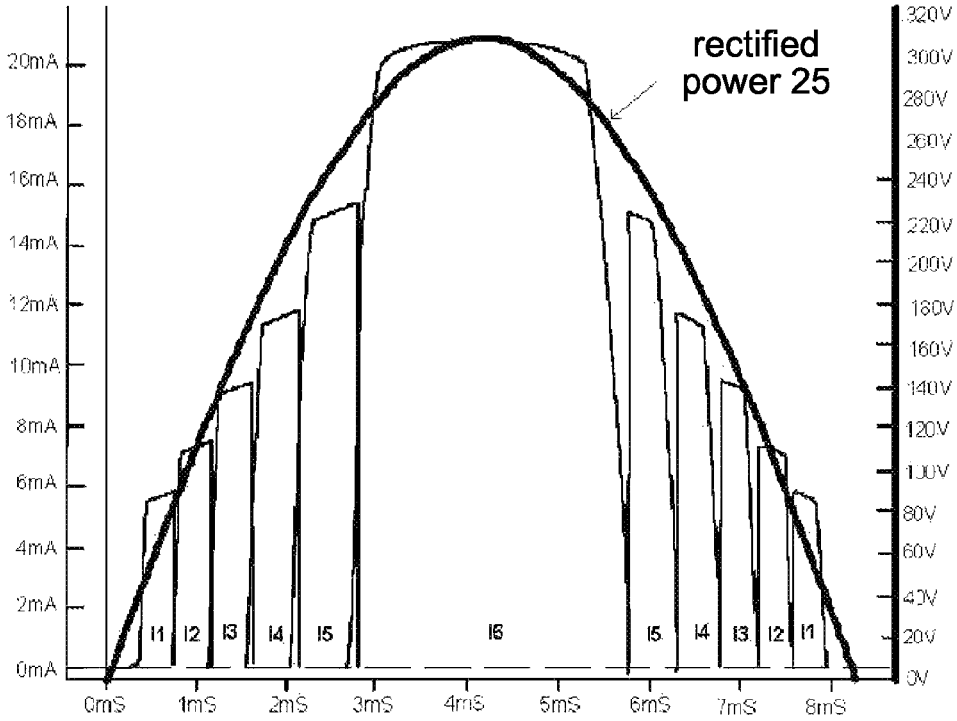
FIG. 7 is a curve of conduction currents v.s. a rectified power.
Figure 8:
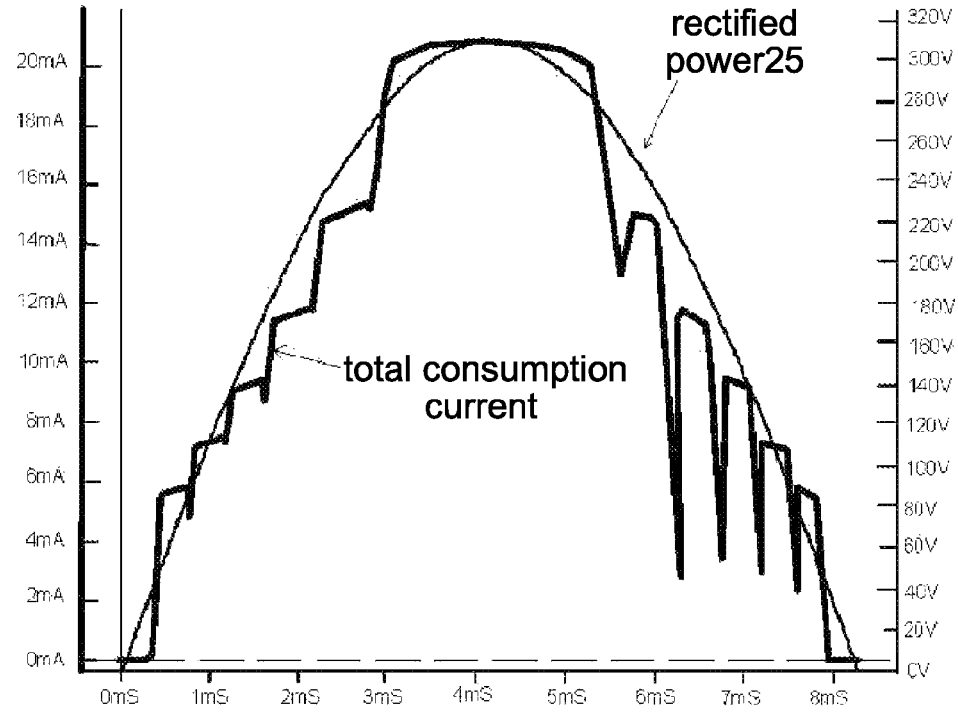
FIG. 8 is a curve of a total consumption current v.s. the rectified power.

Reference is made to FIG. 6 which is a timing diagram of the control unit. Reference is made to FIG. 7 and FIG. 8 which are a curve of conduction currents and a rectified power and a curve of a total consumption current and the rectified power, respectively. When the rectified power 25 drives the LED stacks 30_1-30_6, the current-sensing units 46*b*-46*f* monitor the current flowing in the current-clamping units 44*b*-44*f* and feed back the monitored data to the control unit 42. Accordingly, the control unit 42 sequentially switches on or off the current-clamping units 44*b*-44*f* according to the combinatorial logic state of the monitored data.

An example is provided as follows. Initially, the rectified power 25 supplies a small voltage that can only drive the LED stack 30_1, thus only the current (namely, the conduction current I1) flows through the current-clamping unit 44*a*. Afterward, when the supplied voltage by the rectified power 25 is sufficiently large to drive the LED stacks 30_1-30_2, the current-sensing unit 46*b* monitors the conduction current I2 and the monitored data are sent to the control unit 42. Also, the current-clamping unit 44*a* is turned off by the control unit 42. Afterward, when the supplied voltage by the rectified power 25 is sufficiently large to drive the LED stacks 30_1-30_3, the current-sensing unit 46*c* monitors the conduction current I3 and the control unit 42 is notified. Also, the current-clamping unit 44*a* and the current-clamping unit 44*b* are immediately turned off by the control unit 42. The operation for the rest of the current-sensing units 46*c*-46*f* can be deduced by the same analogy. On the other hand, when the rectified power 25 initially supplies a peak voltage, the operation of the control unit 42 is the same as the above-mentioned operation of the control unit 42, the detailed description is omitted here for conciseness.

The integrated circuit for driving high-voltage LED lamps can be integrated and conform the demands of the existing lighting regulation. The test results are as follows:

1. The power factor (PF) is 96%.
2. The total harmonic distortion (THD) is 11.5%.
3. The efficiency is 90.5%.
4. The luminous efficacy is 104 lm/W.

In particular, the luminous efficacy of a typical LEDs is 115 lm/W.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An integrated circuit for driving high-voltage LED lamps applied with a full-wave rectified power, the integrated circuit comprising:

a plurality of LED stacks connected in series, each of the LED stacks including a first side and a second side, the second side of an LED stack being electrically connected to the first side of a next LED stack in the series;

a control unit;

a plurality of current-clamping units electrically connected to the control unit and LED stacks; and at least one current-sensing unit electrically connected to the current-clamping units and the control unit;

wherein a first current-clamping units is electrically connected to the second side of the first LED stack and the first side of the second LED stack, and a last current-clamping unit is electrically connected to the second side of a last LED stack, when an electrical current flowing through the current-clamping unit is greater than a default current, a respective current-sensing unit outputs a logical high signal to the control unit, and when the electrical current flowing through the current-clamping unit is not greater than the default current, the respective current-sensing unit outputs a logical low signal to the control unit, and wherein the control unit is configured to turn off the first (N-1) current-clamping units when the control unit is informed from the logical high and low signals that the full-wave rectified power is larger enough to drive the first N LED stacks in the LED stack series, wherein N is an integer number larger than 1.

2. An integrated circuit for driving high-voltage LED lamp according to claim 1 wherein the current-clamping unit comprises:

an N-channel MOS; and a feedback resistor electrically connected to a source of the N-channel MOS.

3. An integrated circuit for driving high-voltage LED lamp according to claim 1 wherein the current-sensing unit comprises an NPN transistor.

4. An integrated circuit for driving high-voltage LED lamps, comprising:

a control unit;

a plurality of current-clamping units electrically connected to the control unit and LED stacks; and at least one current-sensing unit electrically connected to the current-clamping units and the control unit;

wherein the current-sensing unit monitors an electrical current flowing through the respective current-clamping unit and feeds back the monitored data to the control unit, and the control unit sequentially switches on or off the current-clamping units according to the combinatorial logic state of the monitored data, wherein the current-sensing unit comprises an NPN transistor, and wherein the current-sensing unit further comprises an inverter, and an input terminal of the inverter is electrically connected to the collector of an NPN transistor.

5. An integrated circuit for driving high-voltage LED lamps according to claim 4 wherein the current-sensing unit further comprises a buffer, and the input terminal of the buffer is electrically connected to the output terminal of the inverter.

6. An integrated circuit for driving high-voltage LED lamps according to claim 5 wherein the current-sensing unit further comprises a pull resistor electrically connected to the collector of the NPN transistor.

7. An integrated circuit for driving high-voltage LED lamps according to claim 6 wherein the current-sensing unit further comprises a base resistor electrically connected to the base of the NPN transistor.

8. An integrated circuit for driving high-voltage LED lamps, comprising:

a control unit;

a plurality of current-clamping units electrically connected to the control unit and LED stacks; and at least one current-sensing unit electrically connected to the current-clamping units and the control unit;

wherein the current-sensing unit monitors an electrical current flowing through the respective current-clamping unit and feeds back the monitored data to the control unit, and the control unit sequentially switches on or off the current-clamping units according to the combinatorial logic state of the monitored data, and wherein the control unit comprises:

at least one first NOT gate; and at least one second NOT gate, and an input terminal of the second NOT gate electrically connected to the output terminal of the first NOT gate.

9. An integrated circuit for driving high-voltage LED lamps according to claim 8, wherein the control unit further comprises:

at least one OR gate, and the input terminal of the OR gate electrically connected to the input terminal of the first NOT gate.

* * * * *